US005851107A

United States Patent [19]

Wang

[11] Patent Number: 5,851,107

[45] Date of Patent: Dec. 22, 1998

[54] SUSPENSION ASSEMBLIES FOR CEILING FANS

[75] Inventor: Yuh Shyong Wang, Taichung Hsien, Taiwan

[73] Assignee: Sen Kun HSU, Taichung Hsien, Taiwan

[21] Appl. No.: 885,264

[22] Filed: Jun. 30, 1997

[51] Int. Cl.[6] ..... I04D 29/64

[52] U.S. Cl. ..... 416/244 R; 416/5; 403/114

[58] Field of Search ..... 416/244 R, 246, 416/5; 248/343; 403/114, 115, 122; 362/96

[56] References Cited

U.S. PATENT DOCUMENTS

| | | | |
|---|---|---|---|
| 1,487,892 | 5/1924 | Ryden | 248/343 |
| 4,729,725 | 3/1988 | Markwardt | 416/244 R |
| 5,090,654 | 2/1992 | Ridings et al. | 248/343 |
| 5,462,412 | 10/1995 | Scofield et al. | 416/244 R |
| 5,613,832 | 3/1997 | Su | 416/244 R |

*Primary Examiner*—Edward K. Look
*Assistant Examiner*—Richard Woo
*Attorney, Agent, or Firm*—Charles E. Baxley, Esq.

[57] ABSTRACT

A suspension assembly includes an upper supporting member securely attached to a ceiling, a suspension rod, and a connecting member. The upper supporting member includes a bowl-like section defined in a lower portion thereof. The bowl-like section includes a first through hole defined in a bottom thereof, and a bowl-like upper suspension member is securely retained in the bowl-like section. A suspension rod includes an upper end which extends through the first through hole and securely attached to the upper suspension member. A suspension seat is securely mounted to the suspension rod and includes an inverted bowl-like seat which has a second through hole extending along a longitudinal axis thereof. An inverted bowl-like lower suspension member is securely received in the bowl-like seat, and the lower end of the suspension rod extends through the second through hole and securely attached to the lower suspension member. The connecting member has an upper side securely connected to the suspension seat and a lower side securely attached to a motor.

17 Claims, 9 Drawing Sheets

SUSPENSION ASSEMBLIES FOR CEILING FANS

BACKGROUND OF THE INVENTION

1. Field of the Invention

The present invention relates to improved suspension assemblies for ceiling fans.

2. Description of the Related Art

A ceiling fan is rotatably mounted to the ceiling by a suspension device. FIG. 10 of the drawings illustrates a typical suspension device which generally includes a U-shaped bracket 10 securely attached to the ceiling by screws. A hole 102 is defined in a mediate section of the bracket 10, and a protrusion 101 is formed on a periphery defining the hole 102. A bowl-like member 13 is retained by the periphery defining the hole 102 of the bracket 10 and includes a threaded bore 132. A suspension rod 12 is extended through the bore 132 and includes a threaded upper end in threading connection with the threaded bore 132, and a pin 122 is extended through a transverse hole 124 defined in the upper end of the suspension rod 12. A motor 16 for driving the ceiling fan 17 is securely attached to a lower end of the suspension rod 12 via a connecting member 18. An outer casing 15 is mounted around the motor 16 and the connecting member 18. The bowl-like member 12 is intended to absorb shocks and vibrations which often occur during rotational movements of the ceiling fan 17. Nevertheless, it is found that such a suspension device cannot effectively absorb the shocks and vibrations as there is only one member (i.e, the bowl-like member 13) which may absorb the shocks and vibrations such that vibrations of the ceiling fan still occur after a period of time. Such a suspension device also fails to effectively absorb the shocks of the ceiling fan having a long suspension rod. As a result, potential risk of disengagement of the ceiling fan from the suspension device still exists.

Therefore, there has been a long and unfulfilled need for an improved suspension assembly which mitigates and/or obviates the above problems.

SUMMARY OF THE INVENTION

In accordance with one aspect of the invention, a suspension assembly for ceiling fans comprises:

an upper supporting member securely attached to a ceiling, the upper supporting member including a bowl-like section defined in a lower portion thereof, the bowl-like section including a first through hole defined in a bottom thereof, a bowl-like upper suspension member being securely retained in the bowl-like section, a suspension rod including an upper end and a lower end, the upper end of the suspension rod extending through the first through hole and securely attached to the upper suspension member, a suspension seat securely mounted to the lower end of the suspension rod and including an inverted bowl-like seat which has a second through hole extending along a longitudinal axis thereof, an inverted bowl-like lower suspension member being securely received in the bowl-like seat, the lower end of the suspension rod extending through the second through hole and securely attached to the lower suspension member, and a connecting member having an upper side securely connected to the suspension seat and a lower side adapted to be securely attached to a motor for driving a ceiling fan.

The inverted bowl-like seat includes a cutout defined in a periphery thereof, and an engaging groove is defined in each of two sides which define the cutout. An arcuate piece is detachably mounted to cover the cutout and includes a strip formed on each of two sides thereof for engaging with the associated engaging groove.

The inverted bowl-like seat includes a spherical inner periphery, and a protrusion is formed on the spherical inner periphery of the inverted bowl-like seat. The lower suspension member includes a notch for receiving the protrusion on the inverted bowl-like seat.

A motor casing is mounted around the connecting member and the motor. The suspension seat includes two pairs of spaced lugs, and the motor casing includes a pair of teeth respectively securely retained between the associated pair of spaced lugs.

In accordance with a further aspect of the invention, a suspension assembly for ceiling fans comprises:

an upper supporting member securely attached to a ceiling, the upper supporting member including a bowl-like upper retaining seat having a spherical inner periphery and a first through hole extending along a longitudinal axis thereof, a bowl-like upper suspension member being securely retained in the upper retaining seat, a suspension rod including an upper end and a lower end, the upper end of the suspension rod extending through the first through hole and securely attached to the upper suspension member, a suspension seat securely mounted to the suspension rod and including an inverted bowl-like lower retaining seat which has a second through hole extending along a longitudinal axis thereof, an inverted bowl-like lower suspension member being securely received in the inverted bowl-like seat, the lower end of the suspension rod extending through the second through hole and securely attached to the lower suspension member, and a connecting member having an upper side securely connected to the suspension seat and a lower side adapted to be securely attached to a motor.

The inner bowl-like inner spherical periphery of the upper retaining seat includes a protrusion formed thereon, and the bowl-like upper suspension member has a notch defined therein so as to be fittingly, securely received in the upper retaining seat.

The lower retaining seat includes a cutout defined in a periphery thereof, and an engaging groove is defined in each of two sides which define the cutout. An arcuate piece is detachably mounted to cover the cutout and includes a strip formed on each of two sides thereof for engaging with the associated engaging groove.

The lower retaining seat includes a spherical inner periphery, and a protrusion is formed on the spherical inner periphery of the lower retaining seat. The lower suspension member includes a notch for receiving the protrusion on the lower retaining seat.

A motor casing is mounted around the connecting member and the motor. The suspension seat includes two pairs of spaced lugs, and the motor casing includes a pair of teeth respectively securely retained between the associated pair of spaced lugs.

In accordance with another aspect of the invention, a suspension assembly for ceiling fans comprises:

an upper supporting member securely attached to a ceiling, the upper supporting member including a first through hole extending along a longitudinal axis thereof, a suspension rod including an upper end and a lower end, the upper end of the suspension rod extending through the first through hole and securely retained in the upper supporting member, a suspension seat securely mounted to the suspension rod and including an inverted bowl-like retaining seat which has a second through hole extending along a longitudinal axis thereof, an inverted bowl-like suspension member being securely received in the bowl-like seat, the lower end of the suspension rod extending through the second through hole and securely attached to the suspension member, and a connecting member having an upper side securely connected to the suspension seat and a lower side adapted to be securely attached to a motor.

The upper end of the suspension rod includes a pin hole, and the upper supporting member includes two spaced blocks. A pin is extended through the pin hole and has two ends respectively secured to the blocks.

The retaining seat includes a cutout defined in a periphery thereof, and an engaging groove is defined in each of two sides which define the cutout. An arcuate piece is detachably mounted to cover the cutout, and the arcuate piece includes a strip formed on each of two sides thereof for engaging with the associated engaging groove.

The retaining seat includes a spherical inner periphery, and a protrusion is formed on the spherical inner periphery of the retaining seat. The suspension member includes a notch for receiving the protrusion on the retaining seat.

A motor casing is mounted around the connecting member and the motor. The suspension seat includes two pairs of spaced lugs, and the motor casing includes a pair of teeth respectively securely retained between the associated pair of spaced lugs.

Other objects, advantages, and novel features of the invention will become more apparent from the following detailed description when taken in conjunction with the accompanying drawings.

DESCRIPTION OF THE PREFERRED EMBODIMENTS

Figure 1:
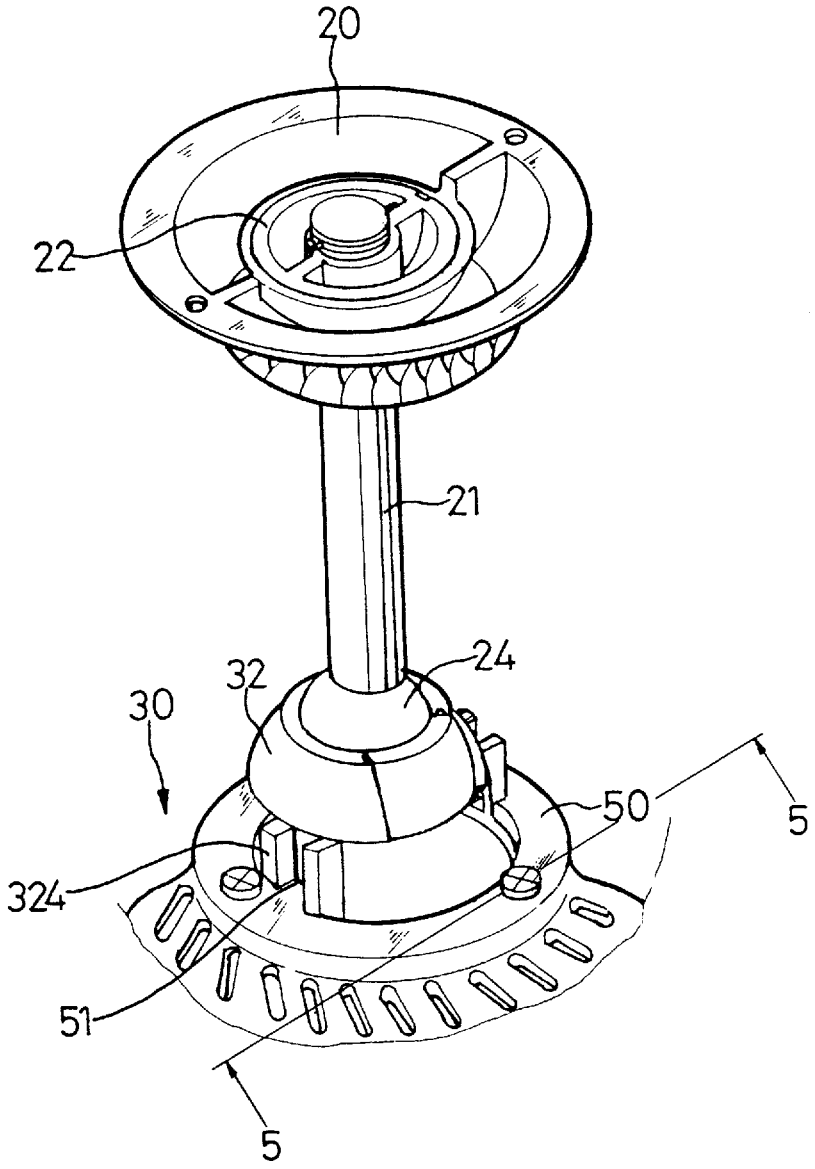
FIG. 1 is a perspective view of a suspension assembly for ceiling fans in accordance with the present invention.
Figure 2:
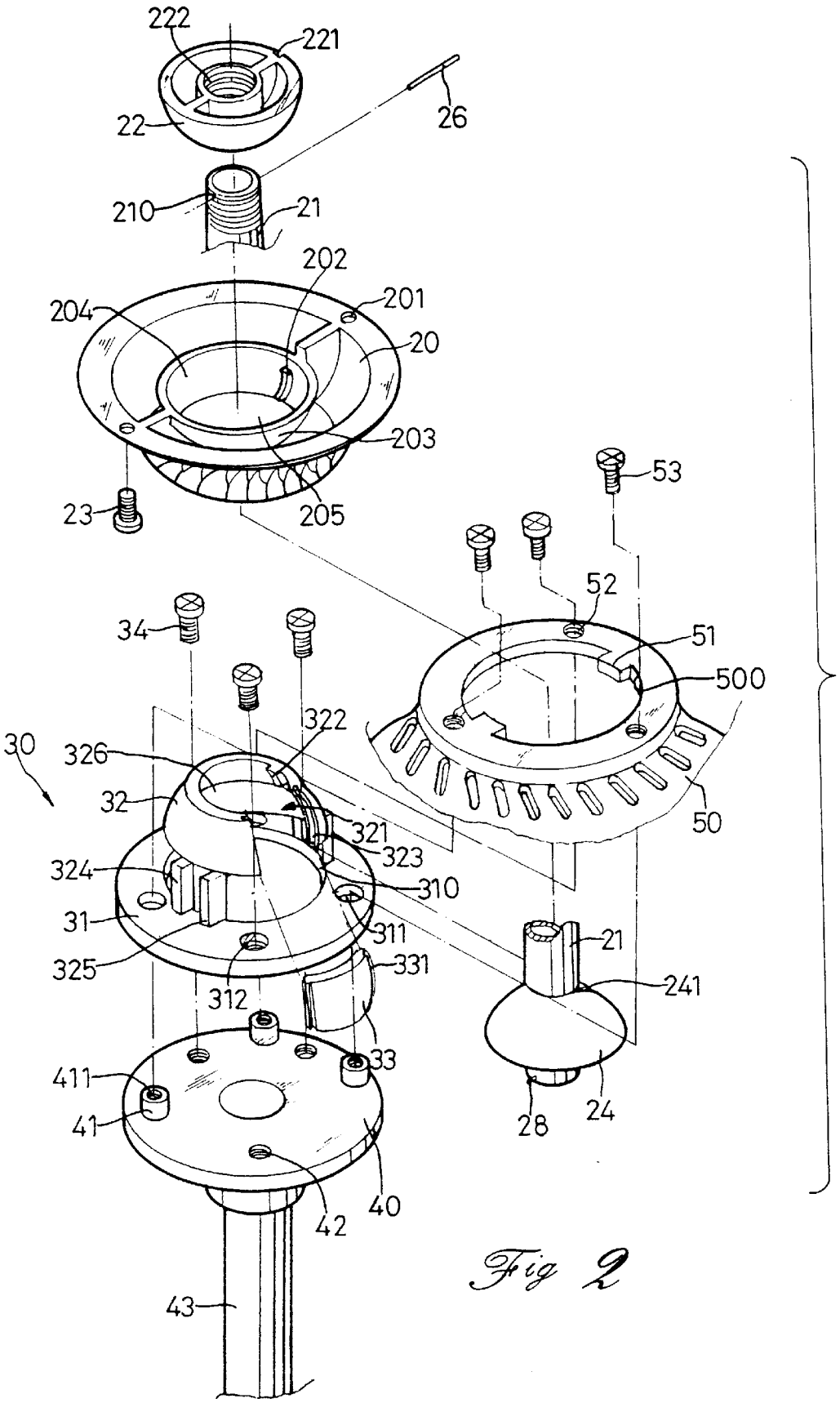
FIG. 2 is an exploded perspective view of the suspension assembly in accordance with the present invention.
Figure 3:
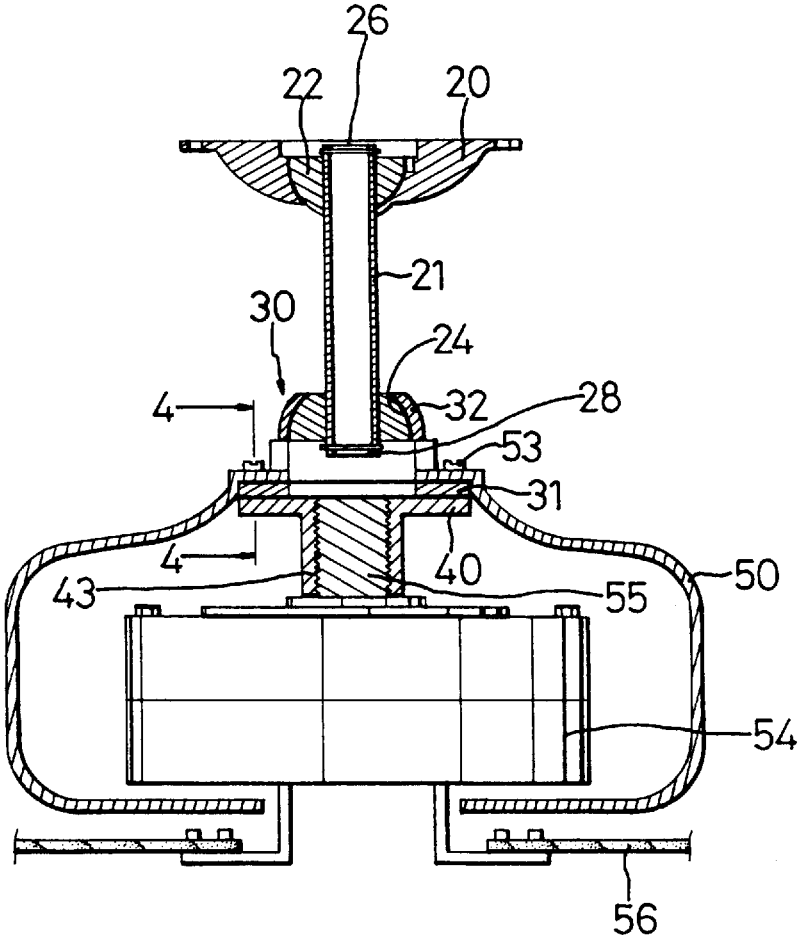
FIG. 3 is a cross sectional view of the suspension assembly and a ceiling fan assembly.

Referring to the drawings and initially to FIGS. 1 to 3, a suspension assembly for ceiling fans in accordance with the present invention generally includes an upper supporting member 20 securely attached to a ceiling (by means of screws 23 extending through holes 201 defined in an outer edge thereof), a suspension rod 21, and a suspension seat 30. The upper supporting device 20 includes a bowl-like retaining seat 203 having a spherical inner periphery 204 and a through hole 205 extending along a longitudinal axis thereof. A protrusion 202 is formed on the inner periphery 204 of the bowl-like retaining seat 203. A bowl-like upper suspension member 22 includes a spherical outer periphery having a notch 221 defined therein so as to be fittingly, securely received in the bowl-like retaining seat 203.

The suspension seat 30 includes a disc 31 having a bore 310 (FIG. 2) defined therein, a plurality of angularly spaced holes 311 defined in the disc 31, and a plurality of angularly spaced screw holes 312 defined in the disc 31. Two pairs of spaced lugs 324 and 325 are diametrically formed on an upper side of the disc 31 and located adjacent to the bore 310. An inverted bowl-like retaining seat 32 is formed on tops of the lugs 324 and 325 and includes a through hole 326 extending along a longitudinal axis thereof. The lugs 324 and 325 may be integral with the retaining seat 32. In this embodiment, the inverted bowl-like seat 32 includes a cutout 321 defined in a periphery thereof, and an engaging groove 323 is defined in each of two sides which define the cutout 321. An arcuate piece 33 is detachably mounted to the cutout 321 and includes a strip 331 formed on each of two sides thereof for engaging with the associated engaging groove 323. In addition, a protrusion 322 is provided on an inner spherical periphery of the inverted bowl-like retaining seat 32. An inverted bowl-like lower suspension member 24 (FIG. 3) is mounted in the seat 32, and the lower suspension member 24 includes a notch (similar to the notch 221 in FIG. 2) for receiving the protrusion 322.

A substantially disc-like connecting member 40 is securely attached to an underside of the disc 31 and includes a plurality of screw holes 42 defined therein and respectively in alignment with the screw holes 312 in the disc 31. In addition, the connecting member 40 further includes a plurality of stubs 41 formed on an upper side thereof, each stub 41 having a screw hole 411 defined therein and in alignment with the holes 311 in the disc 31. A tube 43 extends downwardly from an underside of the connecting member 40, which will be described later.

A motor 54 is securely attached to the connecting member 40 by means of a rod 55 (integrally formed on an upper side of the motor 54) in threading connection with the tube 43. Nevertheless, other means can be provided to securely attach the motor 54 to the connecting member 40. Fan blades 56 are securely attached to the motor 54 to rotate there-with, which is conventional and therefore not further described.

A motor casing 50 is securely mounted around the motor 54 and also encloses the disc 31 and the connecting member 40. In this embodiment, the motor casing 50 includes a hole 500 (FIG. 2) defined in an upper side thereof, and a pair of diametrically disposed teeth 51 are formed on an inner periphery defining the hole 500. In addition, a plurality of screw holes 52 are defined in the upper side of the motor casing 50.

In assembly, referring to FIGS. 2 and 3, the upper suspension member 22 is mounted in the retaining seat 203 with the notch 221 receiving the protrusion 202. The suspension rod 21 is extended through a hole 222 (FIG. 2) defined in the upper suspension member 22, and a pin 26 is extended through a pin hole 210 (FIG. 2) defined in an upper end of the suspension rod 21 and thus retains the suspension rod 21 in position. The upper supporting device 20 is then securely attached to the ceiling by bolts 23 extending through the holes 201 (FIG. 2).

Figure 4:
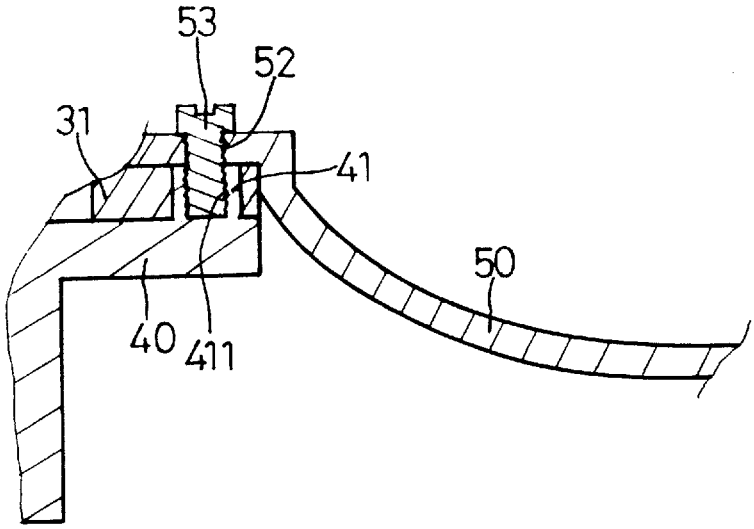
FIG. 4 is a cross sectional view taken along line 4—4 in FIG. 3.
Figure 5:
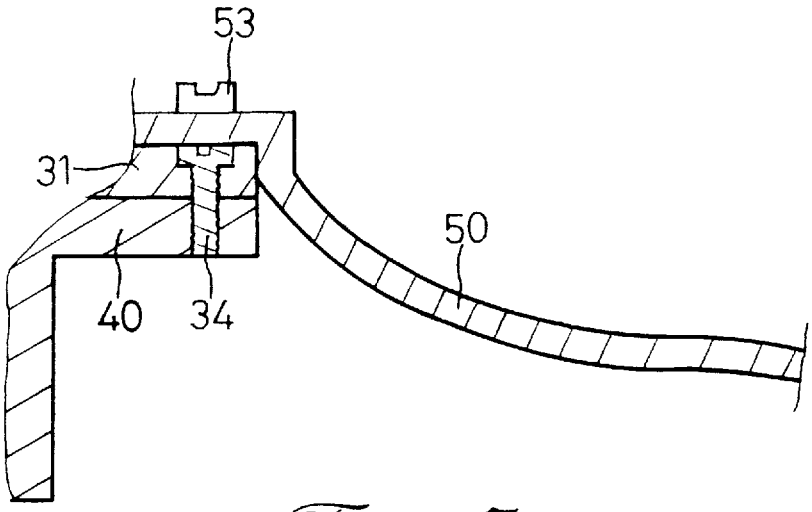
FIG. 5 is a cross sectional view taken along line 5—5 in FIG. 1.

Screws 34 are extended through the holes 311 in the disc 31 and the screw holes 42 in the connecting member 40, as shown in FIG. 5. Then, the motor casing 50 is mounted to enclose the motor 54 and the connecting member 40 in which the teeth 51 are respectively positioned between the associated pair of lugs 324 and 325. Screws 53 are extended through the screw holes 52 in the motor casing 50 and the screw holes 411 in the stubs 41 on the connecting member 40, as shown in FIG. 4.

The lower suspension member 24 is mounted to the lower end of the suspension rod 21 which extends into the suspension seat 30. A pin 28 is extended through a pin hole (not labeled) defined in the lower end of the suspension rod 21. The arcuate piece 33 is securely attached to the seat 32 to cover the cutout 321 in which the strips 331 are respectively received in the engaging grooves 323.

Figure 6:
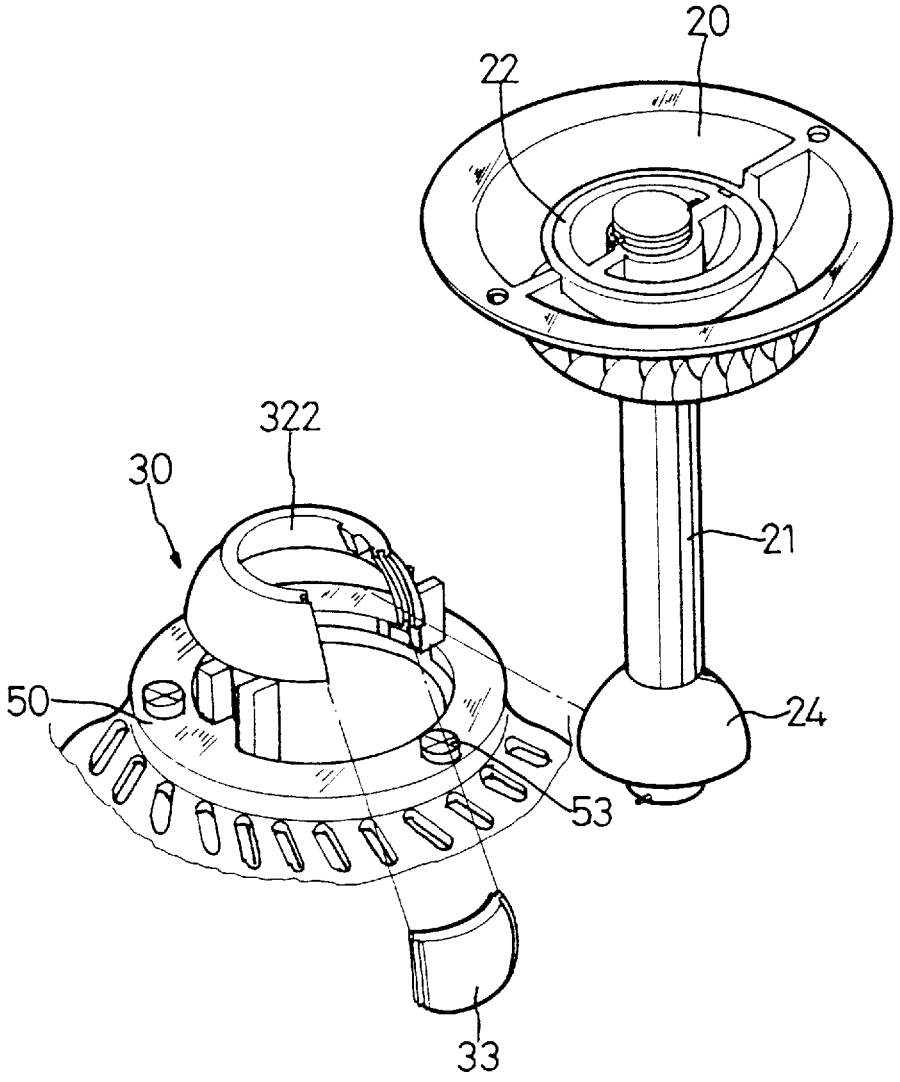
FIG. 6 is an exploded perspective view illustrating assembly of the suspension assembly.

Referring to FIG. 6, the suspension assembly can be assembled by the user himself. More particularly, the suspension seat 30, the connecting member 40, and the motor casing 50 can be assembled in the factory such that the user only has to mount the upper supporting member 20 and the upper suspension member 22 and to insert the lower suspension member 24 into the suspension seat 30 and then attach the arcuate piece 33 to the suspension seat 30, all of these can be accomplished quickly and easily.

Figure 7:
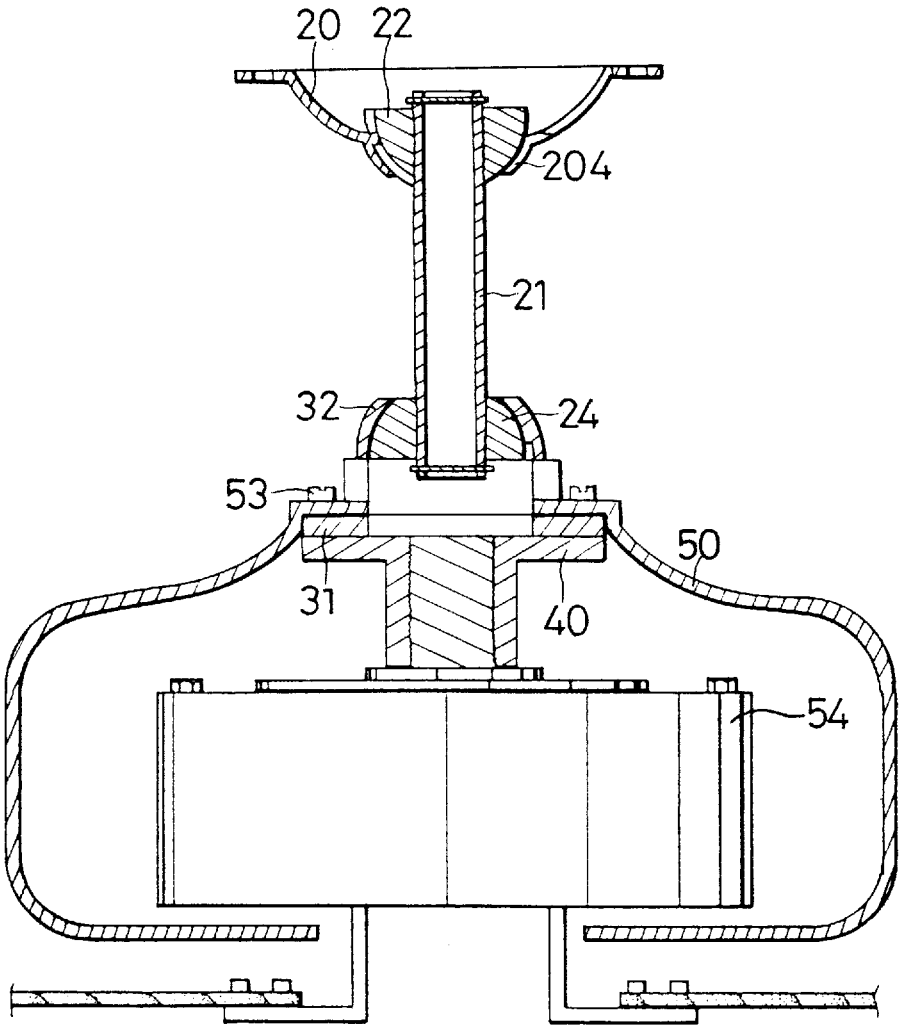
FIG. 7 is a cross sectional view illustrating a second embodiment of the invention.
Figure 8:
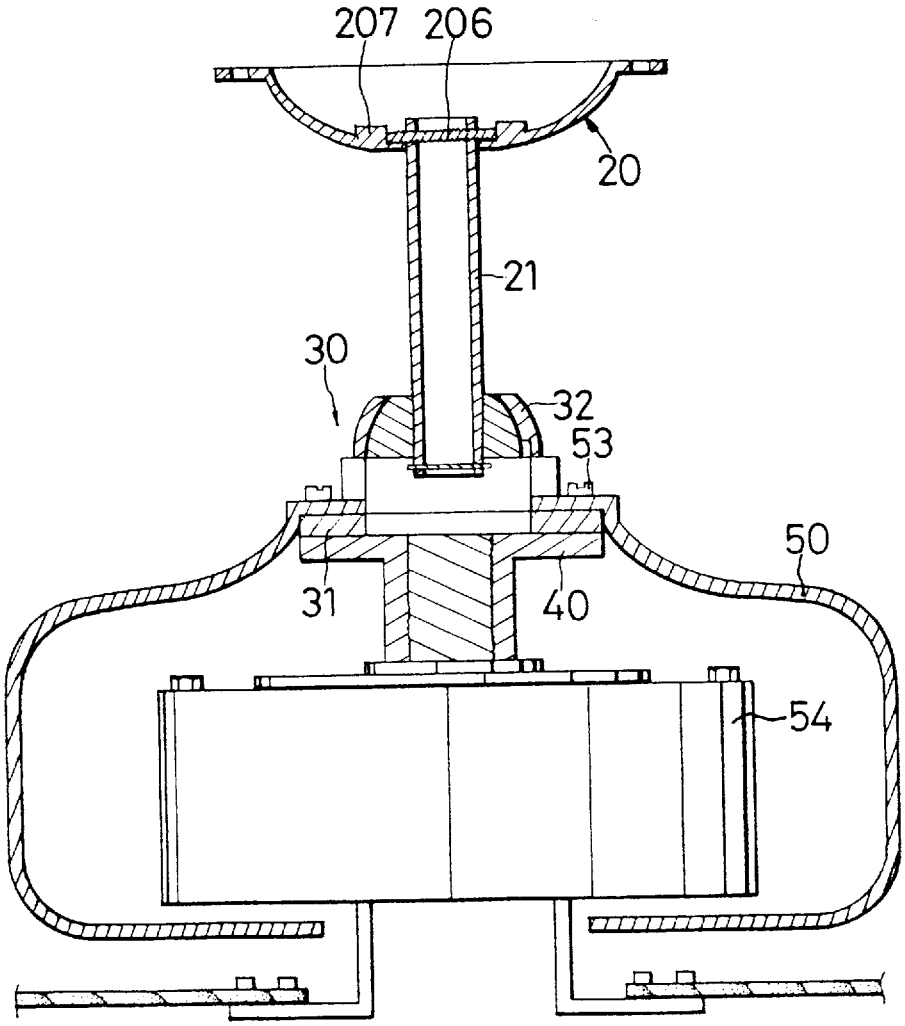
FIG. 8 is a cross sectional view illustrating a third embodiment of the invention.

FIG. 7 illustrates a modified embodiment of the invention, in which the upper supporting member 20 includes a bowl-like section 204' in a lower portion thereof for receiving the upper suspension member 22. The bowl-like section 204' includes a through hole 205' defined in a bottom thereof. FIG. 8 illustrates a further modified embodiment of the invention, in which the upper end of the suspension rod 21 is secured to the upper supporting member 20 by means of a pin 206 securely disposed between two blocks 207 formed on an inner periphery of the upper supporting member 20. The upper end of the suspension rod 21 includes a pin hole (not labeled) through which the pin 206 extends.

Figure 9:
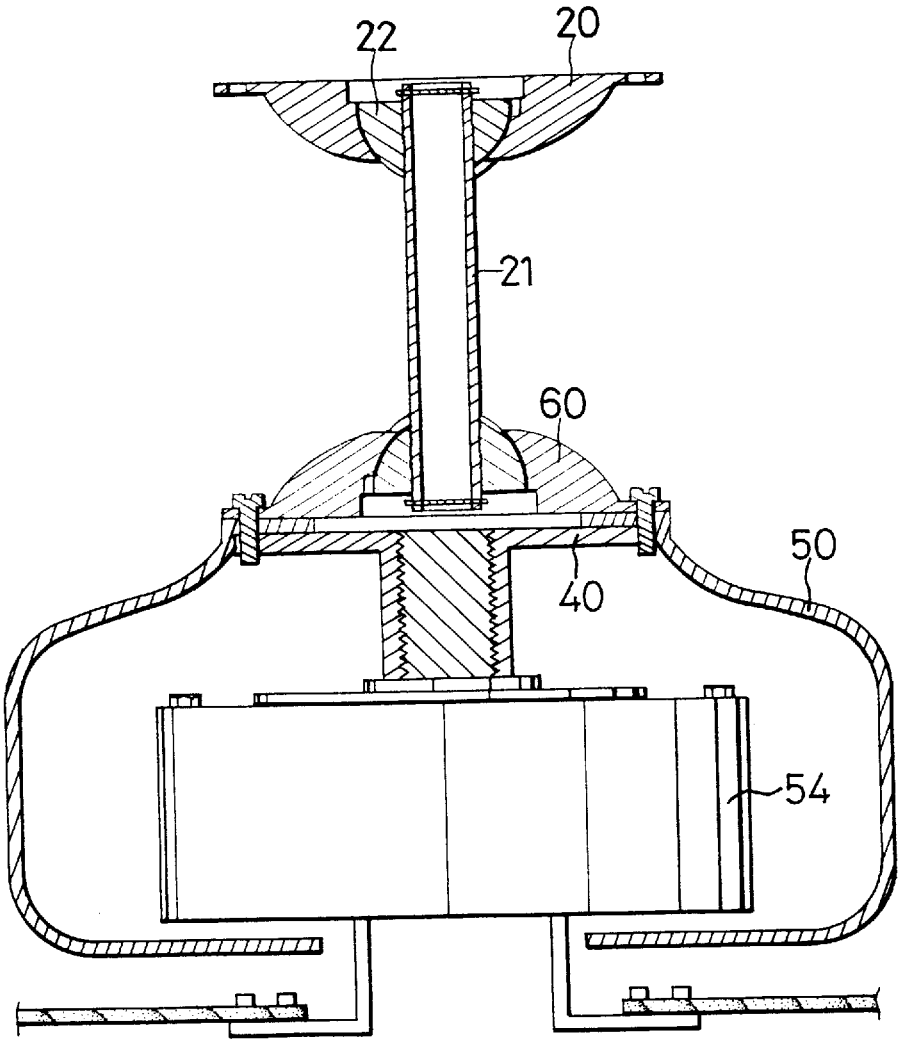
FIG. 9 is a cross sectional view illustrating a fourth embodiment of the invention.
Figure 10:
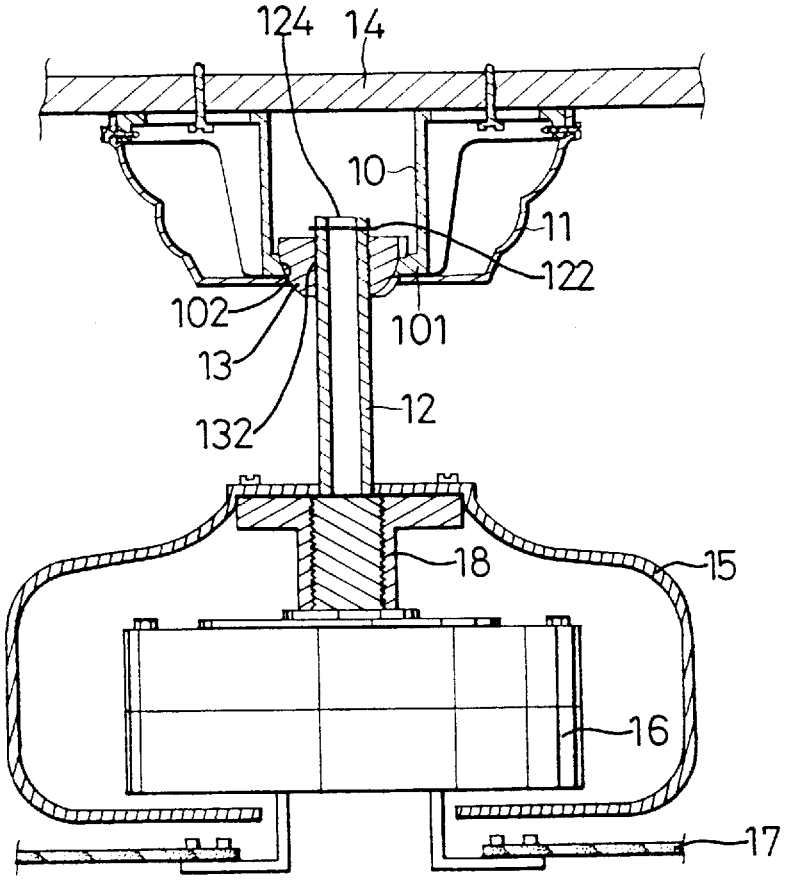
FIG. 10 is a cross-sectional view illustrating a fifth embodiment of the invention.

FIG. 9 illustrates another modified embodiment of the invention, in which the suspension seat (now designated by "60" ) has a structure the same as that of the upper supporting member. The suspension seat 60 and the connecting member 40 can be directly secured to the motor casing 50 by screws.

According to the above description, it is appreciated that the suspension assembly has the following advantages:

(1) The suspension assembly may effectively absorb the shocks and vibrations during rotation of the ceiling fan as there are two bowl-like members 22 and 24.

(2) The engagements between the connecting member 40, the motor casing 50 and the disc 30 are reliable such that loosening of the screws due to vibrations of the ceiling fan can be prevented.

(3) The suspension assembly can be mounted to an oblique ceiling as the two bowl-like members 22 and 24 may provide an adjustment in the vertical direction.

(4) The suspension assembly can be assembled easily and quickly (FIG. 6).

Although the invention has been explained in relation to its preferred embodiment, it is to be understood that many other possible modifications and variations can be made without departing from the spirit and scope of the invention as hereinafter claimed.

What is claimed is:

1. A suspension assembly for ceiling fans, comprising:

an upper supporting member (20) adapted to be securely attached to a ceiling, the upper supporting member (20) including a bowl-like section (204') defined in a lower portion thereof, the bowl-like section (204') including a first through hole (205') defined in a bottom thereof, a bowl-like upper suspension member (22) being securely retained in the bowl-like section (204'), a suspension rod (21) including an upper end and a lower end, the upper end of the suspension rod extending through the first through hole and securely attached to the upper suspension member (22), a suspension seat (30) securely mounted to the lower end of the suspension rod and including an inverted bowl-like seat (32) which has a second through hole (326) extending along a longitudinal axis thereof, an inverted bowl-like lower suspension member (24) being securely received in the bowl-like seat (32), the lower end of the suspension rod extending through the second through hole and securely attached to the lower suspension member, and a connecting member (40) having an upper side securely connected to the suspension seat and a lower side adapted to be securely attached to a motor for driving a ceiling fan.

2. The suspension assembly according to claim 1, wherein the inverted bowl-like seat (32) includes a cutout (321) defined in a periphery thereof, and an engaging groove (323) is defined in each of two sides which define the cutout, and further comprises an arcuate piece (33) detachably mounted to cover the cutout, the arcuate piece includes a strip (331) formed on each of two sides thereof for engaging with the associated engaging groove.

3. The suspension assembly according to claim 1, wherein the inverted bowl-like seat (32) includes a spherical inner periphery, a protrusion (322) is formed on the spherical inner periphery of the inverted bowl-like seat, and the lower suspension member (24) includes a notch for receiving the protrusion (322) on the inverted bowl-like seat (32).

4. The suspension assembly according to claim 1, further comprising a motor casing (50) mounted around the connecting member (40) and the motor (54).

5. The suspension assembly according to claim 4, wherein the suspension seat (30) includes two pairs of spaced lugs (324, 325), and the motor casing (50) includes a pair of teeth respectively securely retained between the associated pair of spaced lugs.

6. A suspension assembly for ceiling fans, comprising:

an upper supporting member (20) adapted to be securely attached to a ceiling, the upper supporting member (20) including a bowl-like upper retaining seat (203) having a spherical inner periphery and a first through hole extending along a longitudinal axis thereof, a bowl-like upper suspension member (22) being securely retained in the upper retaining seat, a suspension rod (21) including an upper end and a lower end, the upper end of the suspension rod extending through the first through hole and securely attached to the upper suspension member (22), a suspension seat (30) securely mounted to the suspension rod and including an inverted bowl-like lower retaining seat (32) which has a second through hole (326) extending along a longitudinal axis thereof, an inverted bowl-like lower suspension member (24) being securely received in the inverted bowl-like seat (32), the lower end of the suspension rod extending through the second through hole and securely attached to the lower suspension member, and a connecting member (40) having an upper side securely connected to the suspension seat and a lower side adapted to be securely attached to a motor.

7. The suspension assembly according to claim 6, wherein the inner bowl-like inner spherical periphery (204) of the upper retaining seat (203) includes a protrusion (202) formed thereon, and the bowl-like upper suspension member (22) has a notch (221) defined therein so as to be fittingly, securely received in the upper retaining seat.

8. The suspension assembly according to claim 7, wherein the lower retaining seat (32) includes a cutout (321) defined in a periphery thereof, and an engaging groove (323) is defined in each of two sides which define the cutout, and further comprises an arcuate piece (33) detachably mounted to cover the cutout, the arcuate piece includes a strip (331) formed on each of two sides thereof for engaging with the associated engaging groove.

9. The suspension assembly according to claim 7, wherein the lower retaining seat (32) includes a spherical inner periphery, a protrusion (322) is formed on the spherical inner periphery of the lower retaining seat, and the lower suspension member (24) includes a notch for receiving the protrusion (322) on the lower retaining seat (32).

10. The suspension assembly according to claim 7, further comprising a motor casing (50) mounted around the connecting member (40) and the motor (54).

11. The suspension assembly according to claim 10, wherein the suspension seat (30) includes two pairs of spaced lugs (324, 325), and the motor casing (50) includes a pair of teeth respectively securely retained between the associated pair of spaced lugs.

12. A suspension assembly for ceiling fans, comprising:

an upper supporting member (20) adapted to be securely attached to a ceiling, the upper supporting member (20) including a first through hole extending along a longitudinal axis thereof, a suspension rod (21) including an upper end and a lower end, the upper end of the suspension rod extending through the first through hole and securely retained in the upper supporting member (20), a suspension seat (30) securely mounted to the suspension rod and including an inverted bowl-like retaining seat (32) which has a second through hole (326) extending along a longitudinal axis thereof, an inverted bowl-like suspension member (24) being securely received in the bowl-like seat (32), the lower end of the suspension rod extending through the second through hole and securely attached to the suspension member (24), and a connecting member (40) having an upper side securely connected to the suspension seat and a lower side adapted to be securely attached to a motor.

13. The suspension assembly according to claim 12, wherein the upper end of the suspension rod includes a pin hole, the upper supporting member includes two spaced blocks (207), and a pin (206) is extended through the pin hole and has two ends respectively secured to the blocks.

14. The suspension assembly according to claim 12, wherein the retaining seat (32) includes a cutout (321) defined in a periphery thereof, and an engaging groove (323) is defined in each of two sides which define the cutout, and further comprises an arcuate piece (33) detachably mounted to cover the cutout, the arcuate piece includes a strip (331) formed on each of two sides thereof for engaging with the associated engaging groove.

15. The suspension assembly according to claim 12, wherein the retaining seat (32) includes a spherical inner periphery, a protrusion (322) is formed on the spherical inner periphery of the retaining seat, and the suspension member (24) includes a notch for receiving the protrusion (322) on the retaining seat (32).

16. The suspension assembly according to claim 12, further comprising a motor casing (50) mounted around the connecting member (40) and the motor (54).

17. The suspension assembly according to claim 16, wherein the suspension seat (30) includes two pairs of spaced lugs (324, 325), and the motor casing (50) includes a pair of teeth respectively securely retained between the associated pair of spaced lugs.

* * * * *